US005604983A

United States Patent [19]

Simms et al.

[11] Patent Number: 5,604,983

[45] Date of Patent: Feb. 25, 1997

[54] RAZOR SYSTEM

[75] Inventors: Graham J. Simms, Reading, United Kingdom; Daniel B. Lazarchik, Boston, Mass.

[73] Assignee: The Gillette Company, Boston, Mass.

[21] Appl. No.: 412,613

[22] Filed: Mar. 29, 1995

Related U.S. Application Data

[63] Continuation of Ser. No. 228,695, Apr. 14, 1994, abandoned.

[51] Int. Cl.[6] ..... B26B 21/18; B26B 21/56

[52] U.S. Cl. ..... 30/49; 76/104.1

[58] Field of Search ..... 30/49, 50, 346.5, 30/346.54, 346.55, 346.61; 76/104.1, DIG. 8

[56] References Cited

U.S. PATENT DOCUMENTS

| | | | |
|---|---|---|---|
| 2,439,909 | 4/1948 | Ruskin et al. | 30/346 |
| 2,598,711 | 6/1952 | Musso | 30/49 |
| 2,614,321 | 10/1952 | Ackerman | 30/34 |
| 2,989,804 | 6/1961 | Yellon | 30/32 |
| 3,052,023 | 9/1962 | Meohas | 30/53 |
| 3,522,678 | 8/1970 | Scholin | 51/285 |
| 3,702,026 | 11/1972 | Scholin | 30/49 |
| 4,152,828 | 5/1979 | Lund | 30/89 |
| 4,483,068 | 11/1984 | Clifford | 30/49 |
| 4,807,360 | 2/1989 | Cerier et al. | 30/49 |
| 4,854,042 | 8/1989 | Byrne | 30/34.1 |
| 4,875,288 | 10/1989 | Trotta et al. | 30/49 |
| 4,964,214 | 10/1990 | Welsh et al. | 30/49 |
| 4,977,670 | 12/1990 | Clemens et al. | 30/49 |
| 4,979,298 | 12/1990 | Pesiri | 30/49 |
| 4,984,365 | 1/1991 | Leonard et al. | 30/49 X |
| 5,031,317 | 7/1991 | Jacobson | 30/49 |
| 5,031,318 | 7/1991 | Brown et al. | 30/49 |
| 5,048,191 | 9/1991 | Hahn | 30/346.54 |
| 5,056,227 | 10/1991 | Kramer | 30/346.54 |
| 5,088,195 | 2/1992 | Lazarshik et al. | 30/49 |
| 5,101,565 | 4/1992 | Trankiem | 30/346.54 |
| 5,129,289 | 7/1992 | Boland et al. | 76/104.1 |
| 5,153,992 | 10/1992 | Brown et al. | 30/49 |
| 5,263,256 | 11/1993 | Trankiem | 76/104.1 |
| 5,331,740 | 7/1994 | Carson et al. | 30/41 X |

FOREIGN PATENT DOCUMENTS

| | | | |
|---|---|---|---|
| 598803 | 10/1959 | Italy | 30/49 |
| WO88/04980 | 7/1988 | WIPO | B26B 21/00 |

*Primary Examiner*—Douglas D. Watts
*Attorney, Agent, or Firm*—Edward S. Podszus; Owen J. Meegan; Donal B. Tobin

[57] ABSTRACT

A safety razor system includes a body member for attachment to a razor handle having a shell structure and an elongated blade mounted on the shell structure of the body member. The blade is arcuate along its lengthwise directions and has a skin contacting surface with a plurality of apertures formed therein, the perimeter of each aperture serving as a cutting edge. The blade is mounted on the body with the skin contacting surface entirely offset from the body member and is attached to a handle for pivotal movement in the widthwise direction about a pivot center offset from the skin contacting surface in the direction of contact.

13 Claims, 10 Drawing Sheets

RAZOR SYSTEM

This is a continuation of application Ser. No. 08/228,695 filed on Apr. 14, 1994 now abandoned.

BACKGROUND OF THE INVENTION

The present invention relates to a safety razor system and more particularly to a safety razor having a blade structure with annular cutting edges formed on a surface, which surface is intended to be moved over the shaved area in a plurality of directions.

It is known to provide shaving devices wherein the blade structures have annular cutting edges such as in U.S. Pat. No. 2,614,321, issued to Ackerman; U.S. Pat. No. 3,465,436, issued to Musso; U.S. Pat. No. 3,702,026, issued to Scholin; U.S. Pat. No. 4,807,360, issued to Cerier et al.; U.S. Pat. No. 4,875,288, issued to Trotta et al., PCT published application PCT/GB88/0014; and U.S. Pat. No. 5,088,195, issued to Lazarshik et al.

In the above-reference U.S. Pat. No. 5,088,195, the blade member has an aperture that defines an annularly sharpened edge with main facet portions that converge at an angle of less than 30 degrees and supplemental facet portions that are extensions of the main facet portions, and define an ultimate tip defining a portion that has an included angle of less than 30 degrees. The supplemental facet portions are offset in the same direction from the main facet portions each at an angle of less than 175 degrees and the outer main facet portion defines a shaving plane, the ultimate tip being disposed above the shaving plane less than 0.1 millimeters, and the bisector of the included angle defined by the supplementary facets being disposed at an angle to the shaving plane in the range of 15 degrees to 35 degrees. The blade as disclosed is considered to be an improvement over those blades designed to operate in a similar fashion. However, it has been found that improvement in the mounting of the blade into a shaving system is necessary in order to achieve maximum results from a blade of this type.

In the type of blade discussed above, the design is generally such that it is intended that the blade be moved in a plurality of directions over the surface to be shaved which necessitates that the manner of mounting of the blade into a cartridge or razor is of extreme importance if the device is to accomplish the maximum cutting efficiency on each stroke of the razor across the shaved surface.

In order to provide an efficient shaving system, the system must maintain the entire surface of the blade over which the annular openings are formed in contact with the surface to be shaved, as an extreme tilting of the razor on the surface will cause only partial shaving of the surface and require stroking the surface a number of times to achieve a shave which is of high quality.

The efficiency of the system is further increased when the blade is mounted such that the surface of the blade extends flush with or entirely beyond the means for attachment of the blade into a cartridge or razor, thus insuring full contact of the blade surface with the skin during the shaving process.

It is therefore essential, that the blade be manufactured such that it may be mounted into a cartridge or razor structure with the above in mind and that the rotation of the cartridge or razor head relative to the handle be such that lifting of the blade surface from the skin is inhibited during use.

It is therefore the object of the present invention to provide a safety razor system employing a blade structure with annular cutting edges, which system is simple to construct and easy to assemble.

A further object of the invention is to provide a safety razor blade which is provided with a plurality of annular cutting edges and easily assembled into a cartridge or razor structure.

Yet another object of the invention is to provide a safety razor system having a blade structure with annular cutting edges which system is easy to employ and more efficient than those systems which are presently known.

SUMMARY OF THE INVENTION

The above objects and other objectives which will become apparent as the description proceeds are achieved by providing a safety razor system comprising a body member for attachment to a razor handle, the body member comprising a shell structure having a substantially open central portion. A blade having a substantially elongate surface with a plurality of apertures formed therein wherein the perimeter of each aperture forms a cutting edge is mounted onto the top of the shell structure to cover the shell open central portion and has all portions of at least either the surface in which the cutting edges lie the substantially elongate surface disposed entirely at the level of, or above the body member.

The safety razor system generally has a blade which is constructed of metal foil and having a thickness in the area of 0.10 millimeters, the elongate surface generally being arcuate in the lengthwise direction.

The shaving system may further have a skin conditioning strip which extends entirely around the periphery of the blade elongate surface and include means for clamping the blade peripheral surface to the shell structure. The clamping means comprises a cap member extending about the upper surface of, and is affixed to, the shell structure. The cap member has a lip extending inwardly over the shell structure upwardly facing surface which serves to clamp the blade peripheral surface between the lip and the shell.

The safety razor system may further include means for connecting the body member to a handle for pivotal rotation about a pivotal axis disposed above the blade elongate surface for insuring contact of the blade with the surface to be shaved.

In the method aspect, the razor blade is generally manufactured by providing an elongate metal foil sheet and forming a plurality of apertures in the sheet, each aperture having a perimeter providing a cutting edge. The foil is then sprayed with a plastic coating material and heated to a temperature between 600° F. and 700° F. to bond the coating to the blade. The blade is then cold-formed to produce an arcuate surface in the lengthwise direction having the apertures located therein and a second surface extending about the periphery of the sheet which is offset from the arcuate surface.

BRIEF DESCRIPTION OF THE DRAWINGS

Reference is made to the accompanying drawing in which there is shown an illustrative embodiment of the invention from which novel features and advantages will be apparent, wherein.

DESCRIPTION OF THE PREFERRED EMBODIMENTS

Figure 1:
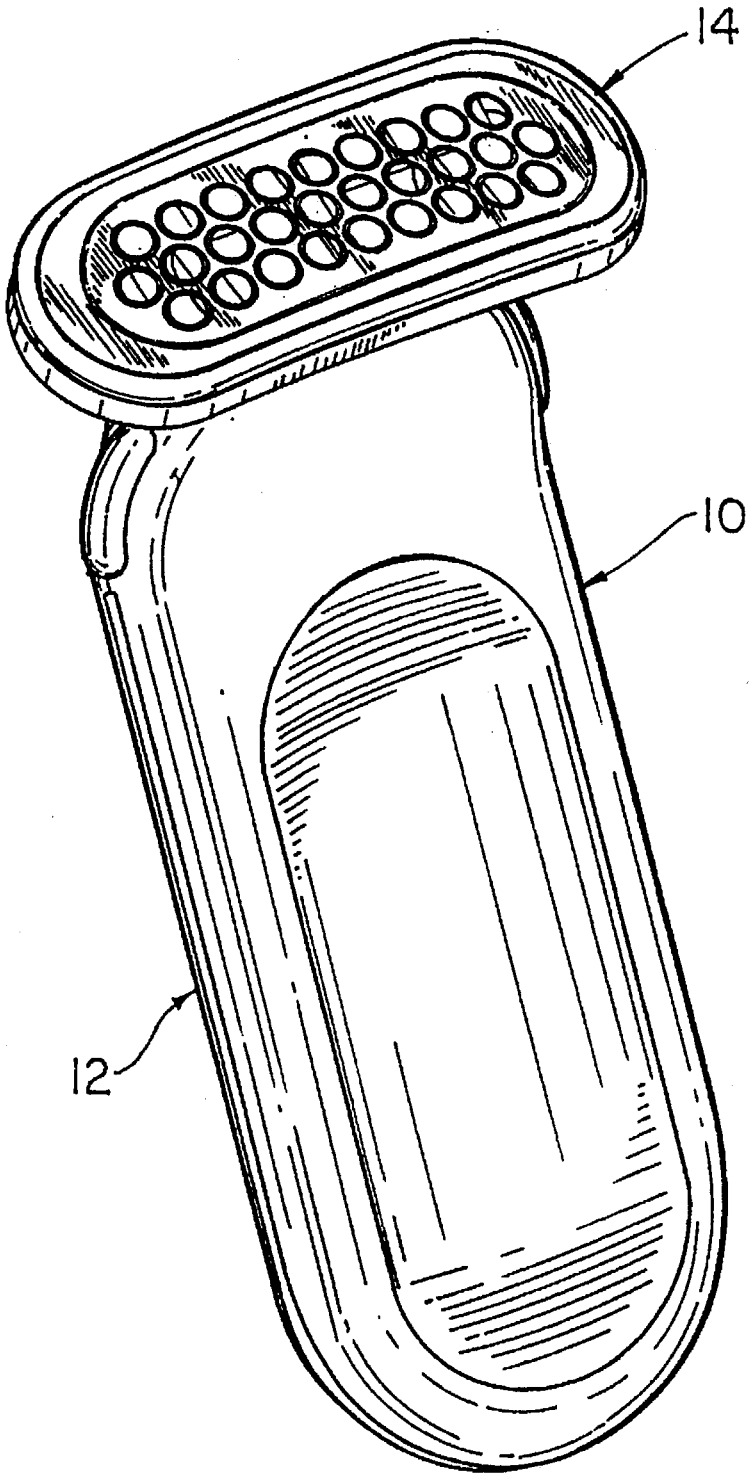
FIG. 1 is an elevational perspective view showing a safety razor system constructed in accordance with the teachings of the present invention.
Figure 2:
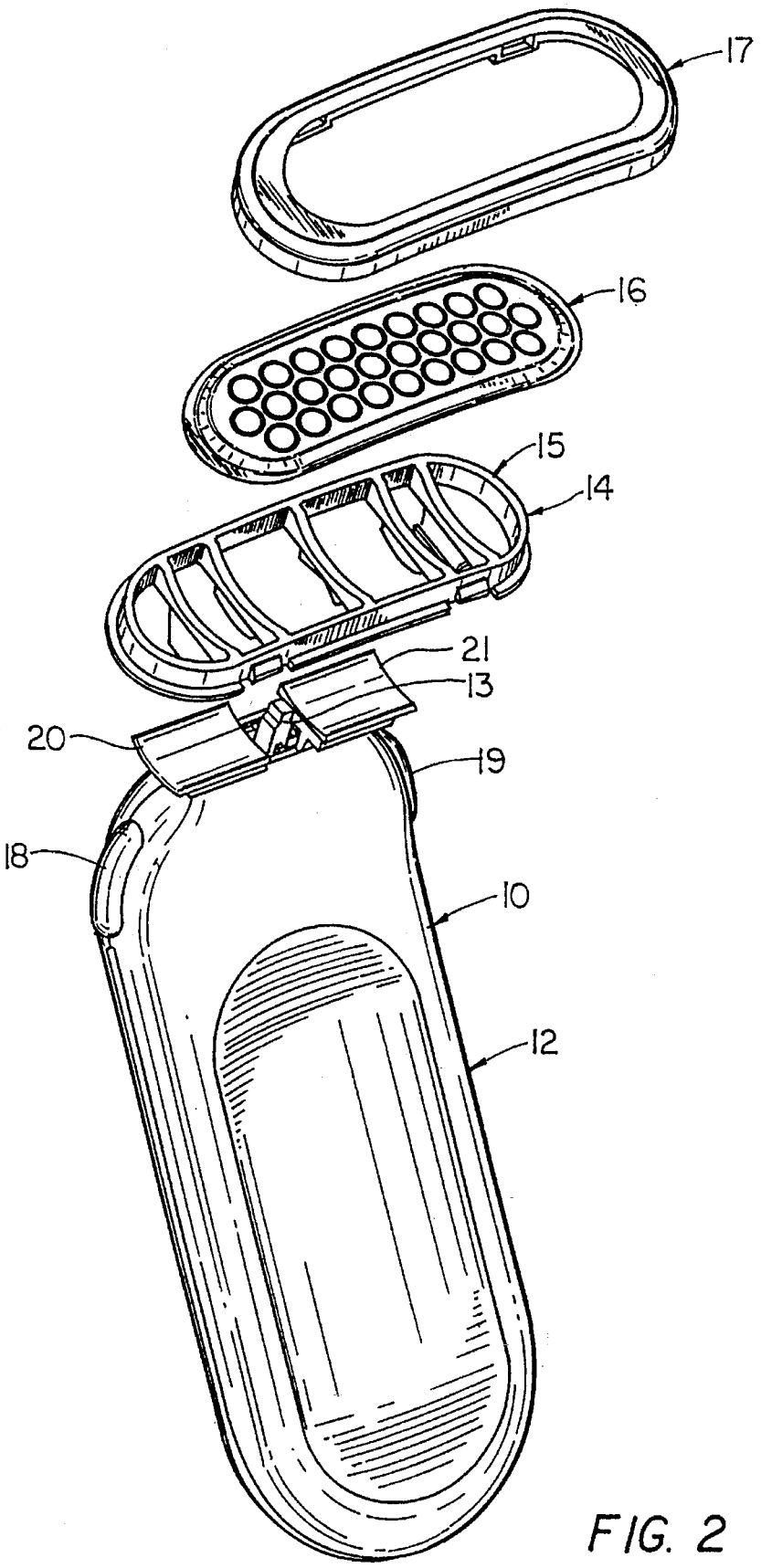
FIG. 2 is an elevational exploded view showing the components of the safety razor system of FIG. 1.

Referring now to the drawing and in particular to FIGS. 1 and 2 there is shown a safety razor system 10 comprising a handle 12 and a body member 14. In the present embodiment the body member 14 is in the form of a razor cartridge which may be attached to, or removed from, the handle 12. As best shown in FIG. 2 the body member 14 comprises a shell structure 15, blade 16 and a cap member 17.

The handle 12 is of a type disclosed in U.S. Pat. No. 5,157,835, issued to Lazarchik et al. on Oct. 27, 1992, and in that respect has a pair of buttons 18 and 19 which are effective to move a pair of bearing members 20 and 21 inwardly to release the cartridge body member 14 from the handle when it is desired to replace the same. The handle further has an actuator pin 13 for contacting the body member 14 during assembly to move the bearing members 20 and 21 outwardly, as in the structure disclosed in the aforementioned U.S. Pat. No. 5,157,835. Since the operation of the handle 12 is fully disclosed in the aforementioned U.S. Pat. No. 5,157,835, which is herein incorporated by reference, the handle will not be described in further detail herein.

Figure 3:
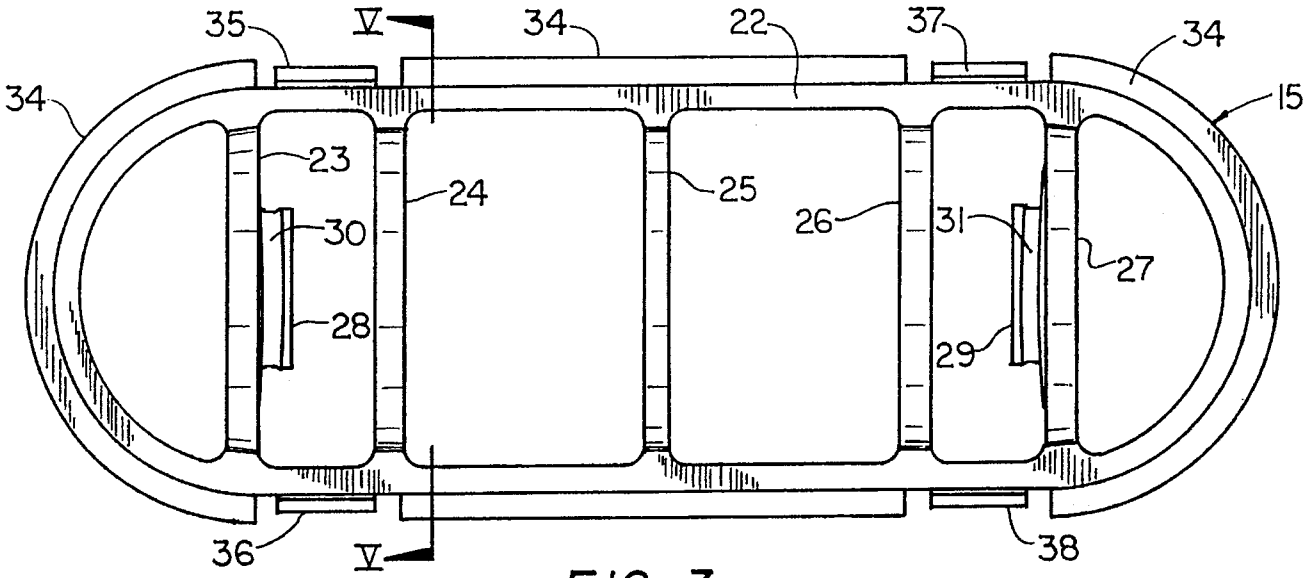
FIG. 3 is a top plan view showing the shell structure of FIGS. 1 and 2 on an enlarged scale for clarity.
Figure 4:
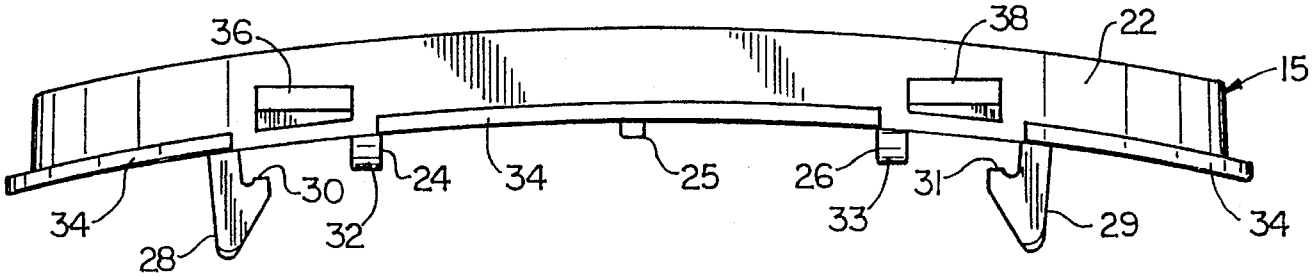
FIG. 4 is a front elevational view of the structure of FIG. 3 showing further details.
Figure 5:
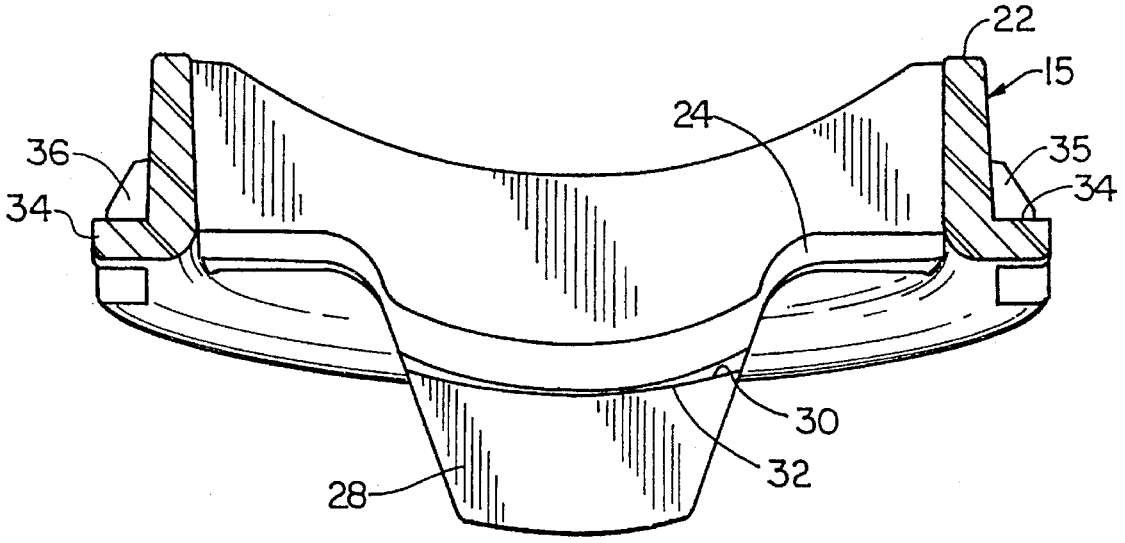
FIG. 5 is an enlarged sectional view of the structure of FIGS. 3 and 4 taken along the line V—V of FIG. 4.
Figure 6:
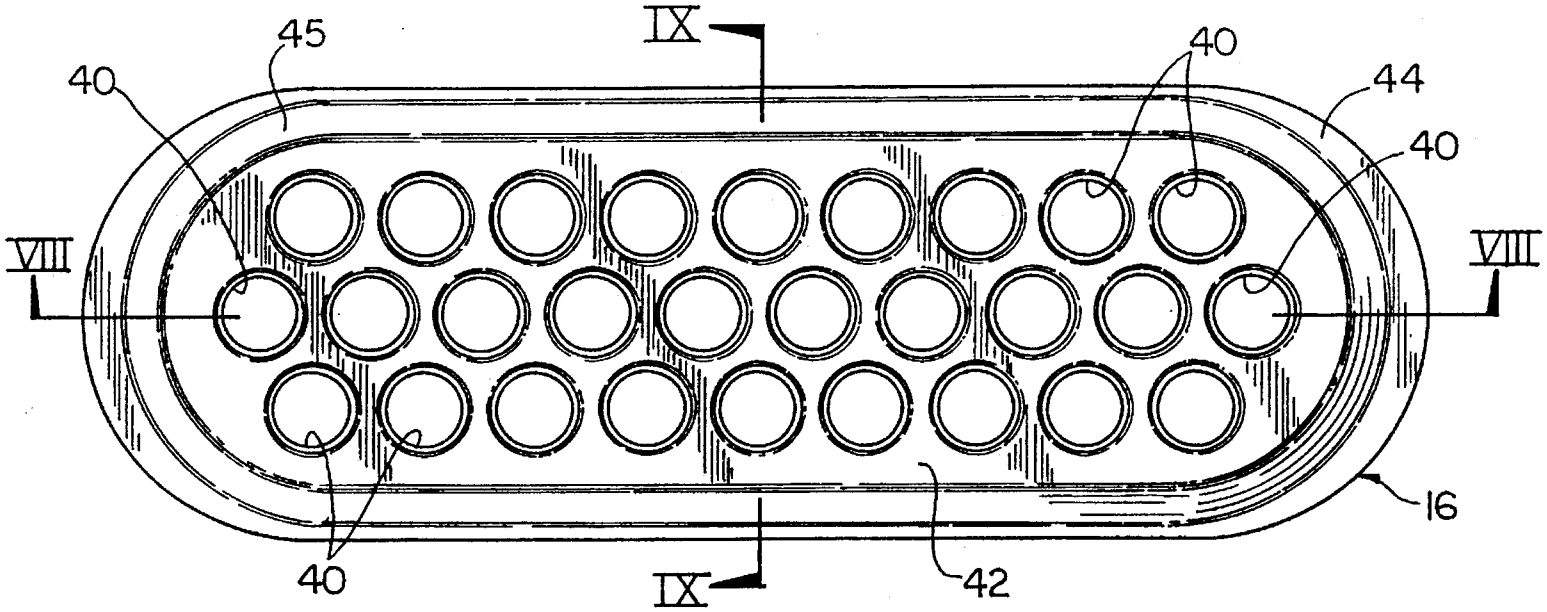
FIG. 6 is a top plan view showing the blade structure of FIGS. 1 and 2.
Figure 7:
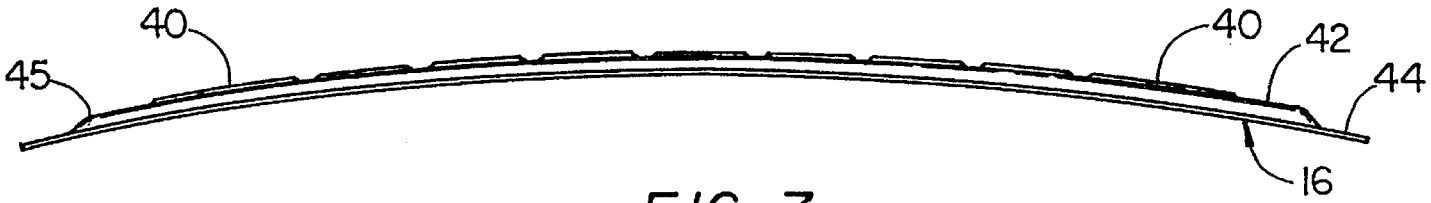
FIG. 7 is a front elevational view showing details of the blade structure of FIG. 6.
Figure 8:
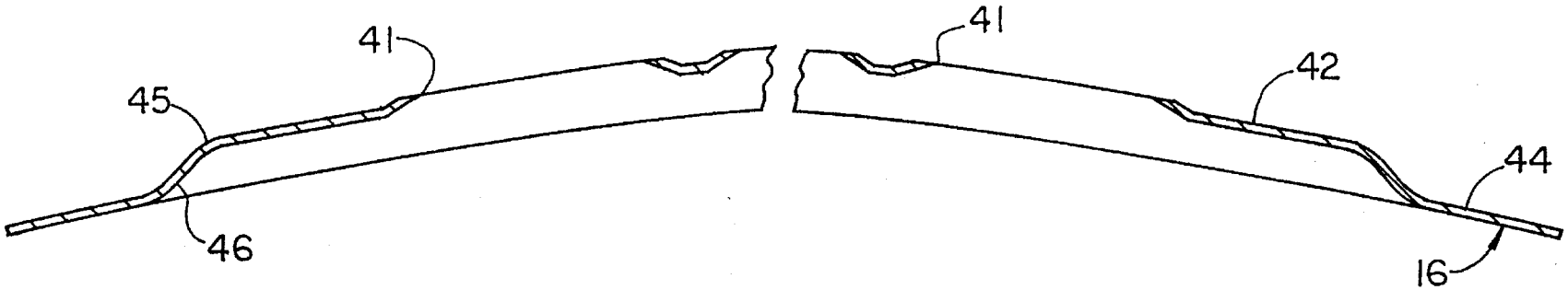
FIG. 8 is an enlarged scale fragmentary section taken along the line VIII—VIII of FIG. 6.
Figure 9:
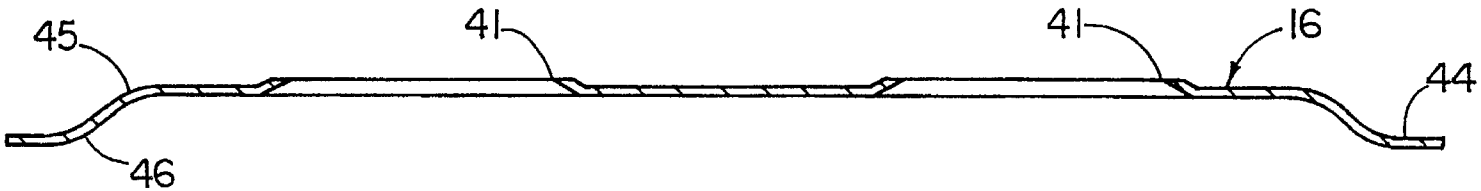
FIG. 9 is an enlarged sectional view taken along the line IX—IX of FIG. 6.
Figure 10:
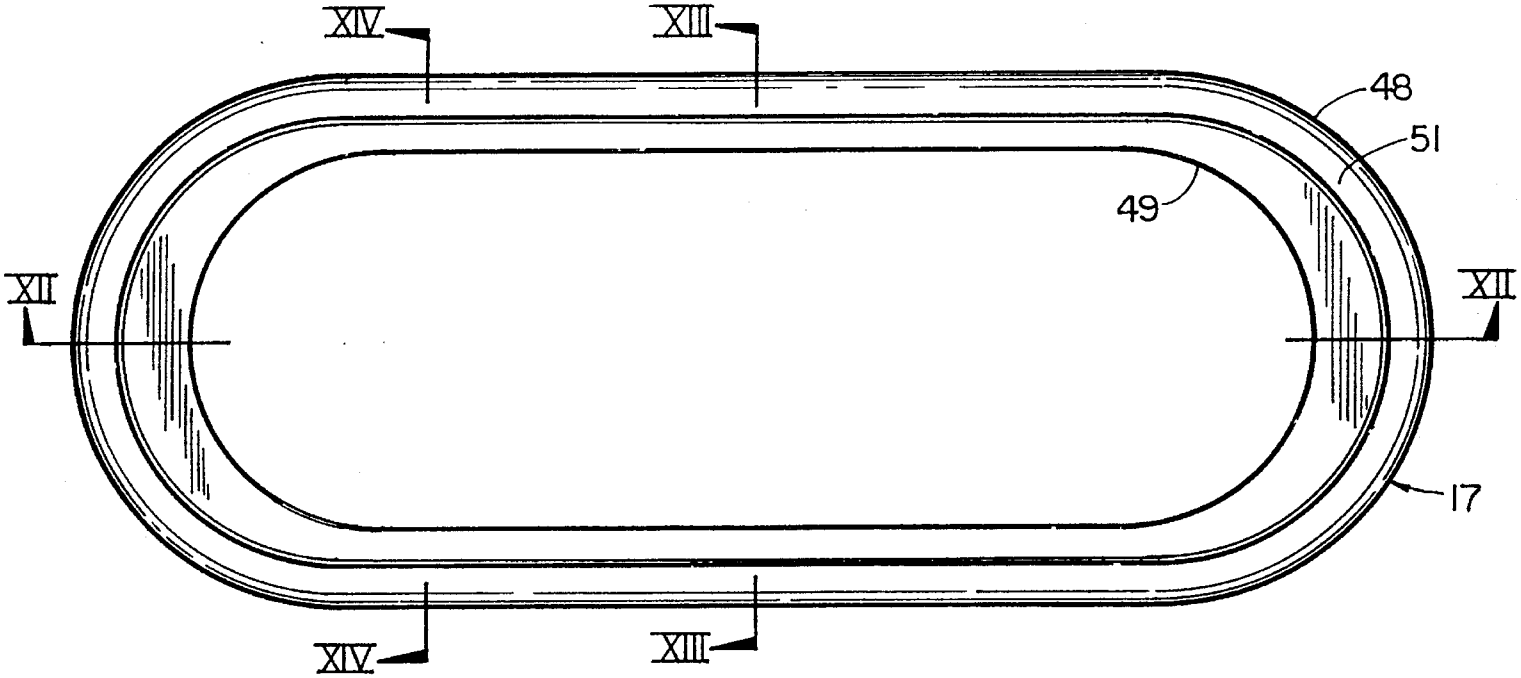
FIG. 10 is an elevational view showing the cap member of FIGS. 1 and 2.
Figure 11:
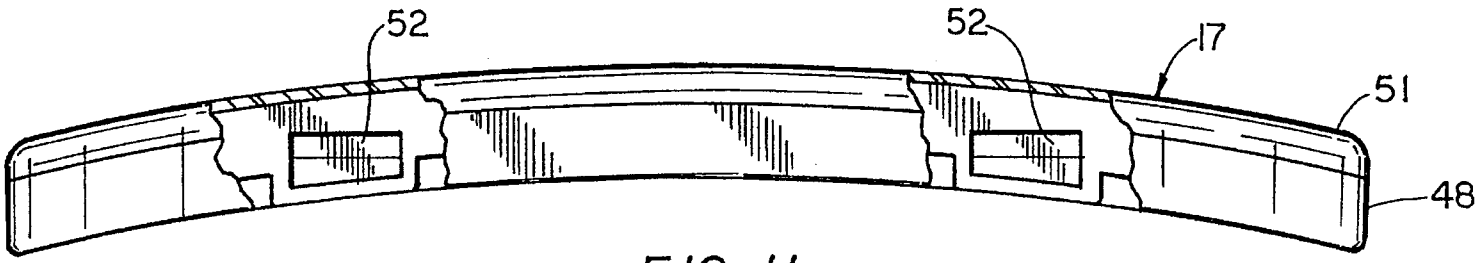
FIG. 11 is a front elevational view, partially in section showing details of the cap member of FIG. 10.

Referring now to FIGS. 3, 4 and 5, the shell structure 15 comprises wall structure 22 having a substantially open central portion but for a plurality of cross bars 23, 24, 25, 26 and 27. Each of the cross bars 23 and 27 has a retainer, 28 and 29 respectively, extending downwardly therefrom and a substantially arcuate upwardly facing surface 30 and 31 for mating engagement with the ends of the bearing members 20 and 21 on the handle 12. Each of the cross bars 24 and 26 has a downwardly extending arcuate surface 32 and 33 respectively which surfaces are positioned to contact the upwardly facing arcuate surfaces of the bearing members 20 and 21 on the handle 12 when the body member 14 is mounted on the handle. The cross bar 25 as best shown in FIG. 4 also extends below the wall 22 to contact the actuating pin 13 which as described above is effective to release the bearing members 20 and 21 to move in the outward direction as explained in the description of the operation of the handle in U.S. Pat. No. 5,157,835.

A flange 34 extends outwardly from the bottom of the wall structure 22 and is disposed substantially over the entire outer surface of the wall structure. The flange 34 has breaks occurring at four positions along the wall 22 at which locations tabs 35, 36, 37 and 38 extend outwardly from the wall 22.

The blade 16, as shown in FIGS. 6 through 9, is manufactured of a steel foil sheet in the area of 0.10 millimeters in thickness and has a plurality of apertures 40 formed in a substantially arcuate elongate surface 42. The perimeter of each of the apertures 40 forms a cutting edge 41 which may be achieved by a process such as that set out in the aforementioned U.S. Pat. No. 5,088,195. The blade 16 further has a peripheral surface 44 extending outwardly from the periphery of the blade and spaced downwardly from the arcuate surface 42.

In manufacturing the blade 16 a substantially flat sheet of foil material is provided with the apertures 40 formed therein and is then hardened after which the edges of the apertures 40 are flat ground to produce the cutting edge 41. The sheet is then electropolished to remove any burrs existing, and sprayed with a Teflon coating after which it is subjected to a heat treatment of 600° F. to 700° F. to bond the Teflon coating to the sheet material.

It has been found that by heat treating the material in the 600° F. to 700° F. temperature range for a period necessary to bond the coating onto the blade, a slight annealing occurs and allows for the forming of the blade into the construction wherein the entire arcuate surface 42 is offset from the peripheral surface 44 and the radii 45 and 46 are formed between the arcuate surface and the peripheral surface. It should here be emphasized that it is important in the construction of the body member 14 that at least one of either the cutting surfaces in which the cutting edges 41 are disposed or the arcuate surface 42 of the blade 16 extends beyond the means for retaining the blade in the body member. The simple formation of the peripheral surface 44 running substantially about the arcuate surface 42 and offset therefrom allows for easy assembly of the blade 16 into the body member 14.

Referring now to FIGS. 10 through 14 the cap member 17 comprises a substantially vertical annular wall 48 having an inwardly extending lip 49 and an upwardly facing groove 50 which a skin conditioning means 51 is contained. The skin conditioning means 51 may be of any type which is well known in the art, and may be press fit into the groove 50 or, as in the present case, may be molded into the groove during the molding process of the cap member 17.

Figure 12:
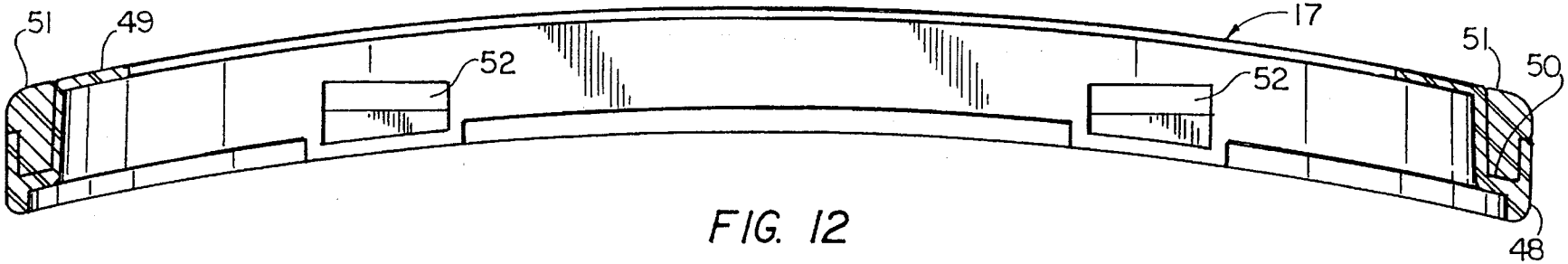
FIG. 12 is an elevational sectional view taken along the line XII—XII of FIG. 10.
Figure 14:
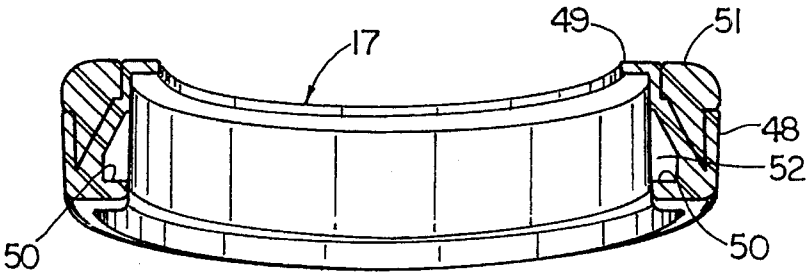
FIG. 14 is an elevational sectional view taken along the line XIV—XIV of FIG. 10.
Figure 13:
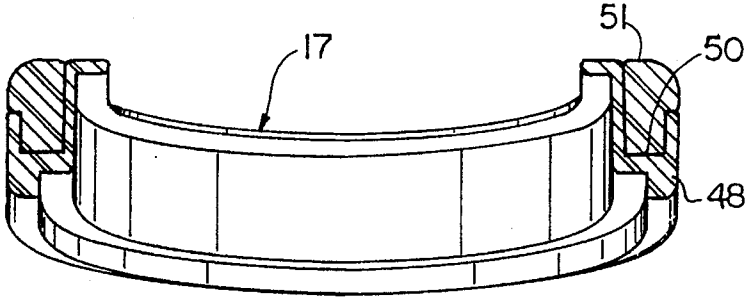
FIG. 13 is an elevational sectional view taken along the lines XIII—XIII of FIG. 10.
Figure 15:
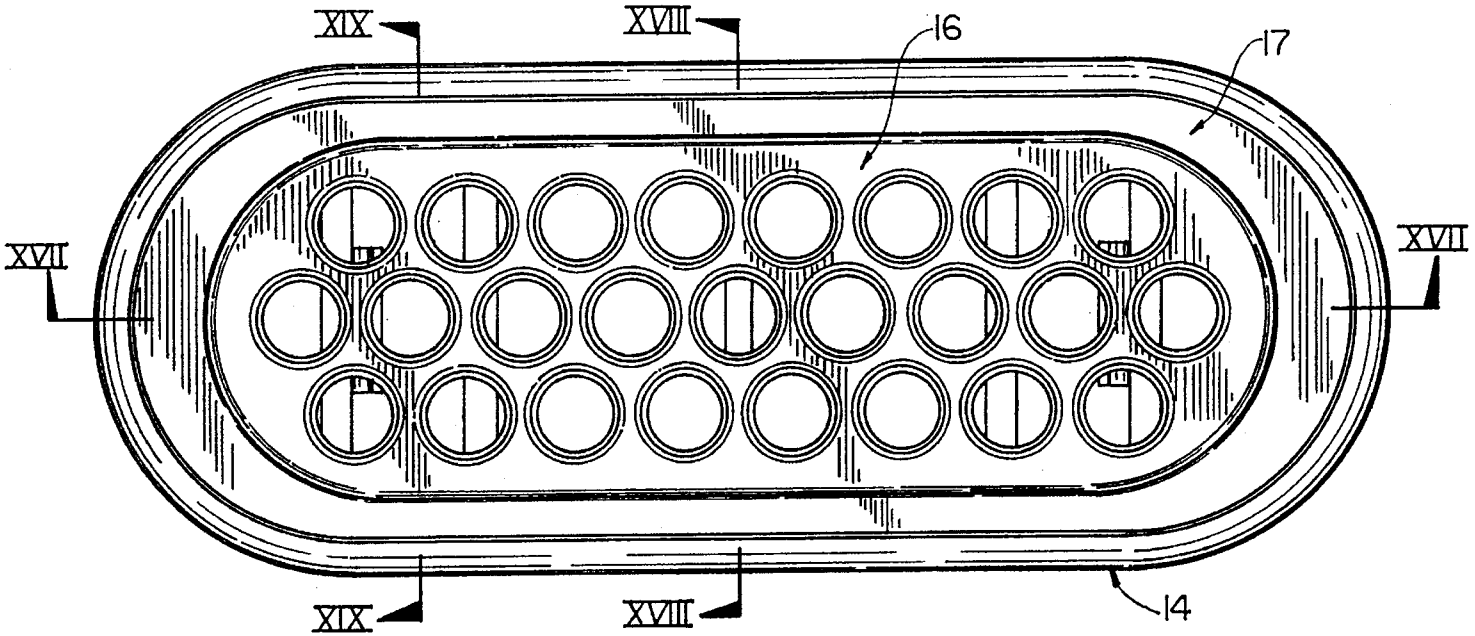
FIG. 15 is a top plan view showing the razor body member of FIGS. 1 and 2 with the shell structure, blade structure and cap member assembled.
Figure 16:
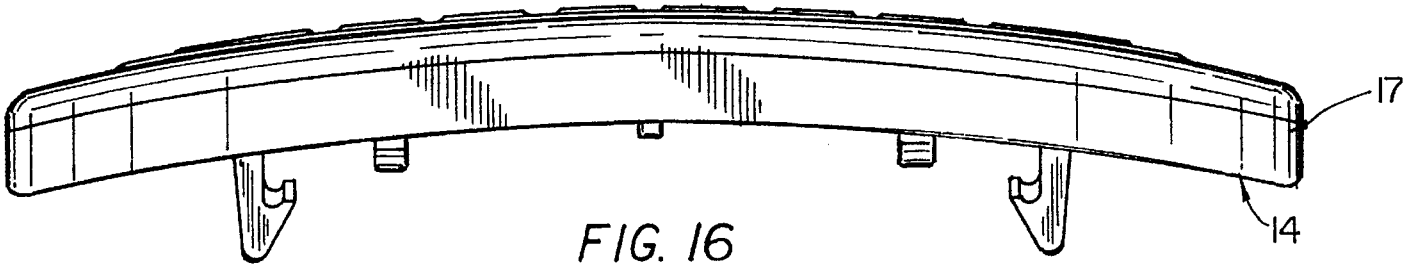
FIG. 16 is a front elevational view showing details of the body member of FIG. 15.

As best shown in FIGS. 12 and 14 four slotted openings 52 are formed on the inner surface of the wall 48 for receiving the tabs 35, 36, 37 and 38 of the shell structure 15, as will be explained below.

In FIGS. 15 through 19 the body member 14 is shown in the assembled condition. In assembling the body member 14 the blade 16 is placed on the shell structure 15 such that the outer edge of the peripheral surface 44 of the blade rests upon the upwardly facing surface of the wall 22 and substantially covers the open interior of the shell structure. The cap member 17 is now forced over the combined shell structure 15 and blade 16 until the tabs 35, 36, 37 and 38 snap into the slotted openings 52 formed in the cap member 17.

Figure 17:
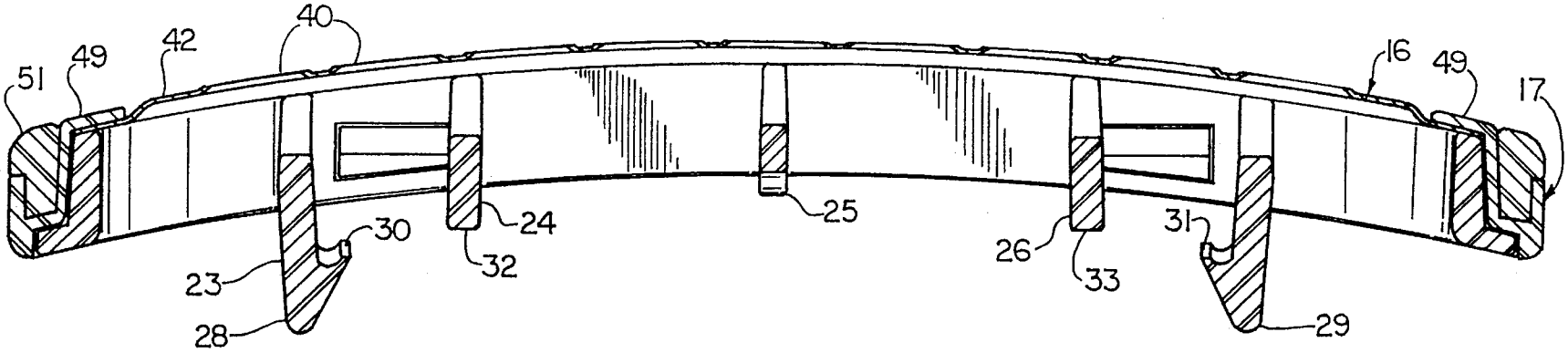
FIG. 17 is an elevational sectional view taken along the lines XVII—XVII of FIG. 15 is an enlarged scale for clarity.
Figure 19:
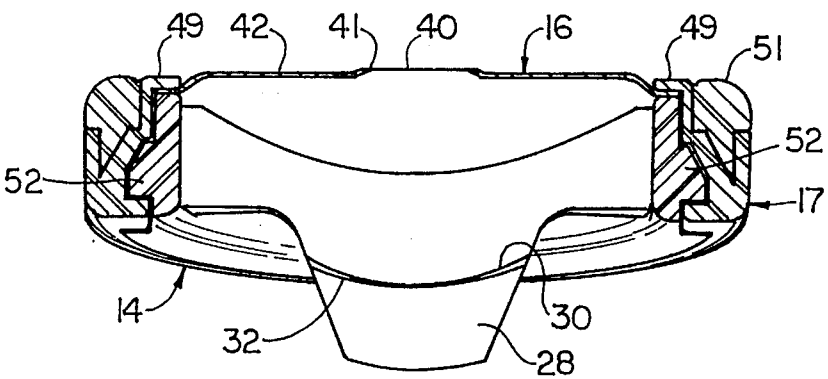
FIG. 19 is an enlarged elevational sectional view taken along the line XIX—XIX of FIG. 15.
Figure 18:
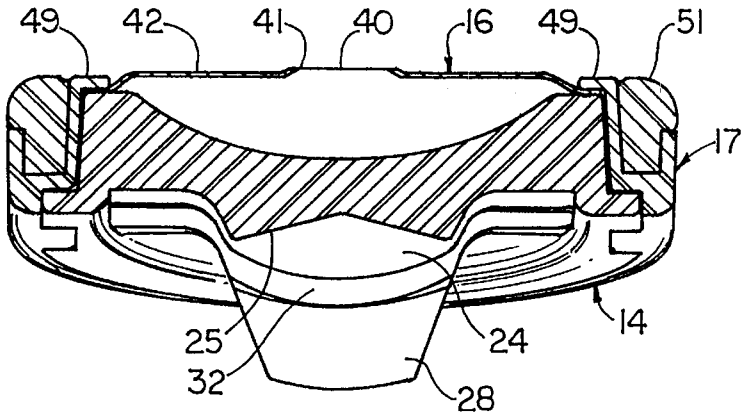
FIG. 18 is an enlarged elevational sectional view taken along the line XVIII—XVIII of FIG. 15.

It will be noted from FIGS. 17, 18 and 19, with the peripheral surface 44 offset from the arcuate surface 42 of the blade, there is sufficient clearance for the lip 49 of the cap member to clamp the blade 16 in place yet the entire body member structure falls below the arcuate surface 42 containing the apertures 40 having the cutting edges 41. Thus, as the blade is moved in all directions over the surface to be shaved, each of the cutting edges 41 of the apertures 40 will contact the skin surface as the body member 14 is moved during the shaving process.

Further, the arcuate surfaces 32 and 33 and the mating surfaces of the bearing members 20 and 21 on the handle 12 are constructed such that the body member 14 rotates along an arc having a radius with a pivot center falling above the blade 16. As a result the body member 14 when attached to the handle 12 has a substantially large arc of rotation which maintains the blade surface 42 in contact with the surface being shaved during movement of the body member which inhibits the edges of the blade being lifted from the shaved surface due to pivoting of the body member on the handle.

From the foregoing it should be evident that the present invention provides a very simple shaving system having only three basic elements to assemble into a body member, which may be constructed as a permanently affixed shaving head in a razor assembly, or a shaving cartridge. In addition to employing only a minimum number of parts, those parts are assembled into a unitary structure without the aid of metallic or plastic fasteners, adhesives, or other fastening means.

While it is apparent that changes and modifications may be made within the spirit and scope of the present invention, it is our intention, however, only to be limited by the appended claims.

As our invention we claim:

1. A razor blade for employment in a shaving system, said blade comprising a metallic foil sheet having a thickness in the area of 0.10 millimeters said sheet having a substantially arcuate planar surface with a plurality of apertures formed therein, the perimeter of each said aperture forming a cutting edge, said cutting edges being disposed on a surface lying above said arcuate planar surface of said sheet, said blade further comprising a peripheral surface extending outwardly from the periphery of said blade planar surface and spaced radially downwardly therefrom for mounting said blade into a shaving system.

2. A razor blade as set forth in claim 1 wherein said foil sheet is of carbon steel material.

3. A razor blade as set forth in claim 1 wherein said foil sheet is elongate and said surface is arcuate in the lengthwise direction.

4. A method of manufacturing a razor blade for employment in a shaving system comprising the steps of;

providing an elongate metallic foil sheet forming a plurality of apertures in said sheet each having a perimeter providing a cutting edge;

spraying said foil sheet with a plastic coating material;

heating said foil sheet to a temperature between 600° F. and 700° F. to bond said coating to said blade, and thereafter cold forming said sheet to produce an arcuate surface in the lengthwise direction having said apertures located therein and a surface extending about the periphery of said sheet which is off-set from said arcuate surface.

5. A safety razor system comprising:

a body member for attachment to a razor handle, said body member comprising a shell structure having an arcuate upwardly facing mounting surface being arcuate in the lengthwise direction, and a substantially open central portion, and a blade having a substantially elongate surface, arcuate in the lengthwise direction, with a plurality of apertures formed therein, the perimeter of each said aperture forming a cutting edge, said blade being mounted onto said upwardly facing mounting surface of said shell structure to cover said shell open central portion and having substantially all said cutting edges of said substantially elongate surface disposed radially outwardly of said upwardly facing mounting surface to form the outermost surface of said body member.

6. The safety razor system of claim 5 wherein said blade is manufactured of a metal foil material having a thickness in the area of 0.10 millimeters.

7. A safety razor system as set forth in claim 5 wherein said body member further comprises skin conditioning means in the form of a continuous solid strip of material, said strip being disposed adjacent said upwardly facing mounting surface of said shell structure and extending above said shell structure.

8. A safety razor shaving system as set forth in claim 6 wherein said strip extends entirely around the periphery of said blade elongate surface.

9. A safety razor system comprising a body member and a handle, said body member comprising a shell structure having an upwardly facing mounting surface and a substantially open central portion;

a blade mounted on said upwardly facing mounting surface of said shell structure and having a substantially elongate arcuate surface with a plurality of apertures formed therein, the perimeter of each said aperture forming a cutting edge, said cutting edges of said substantially elongate arcuate surface disposed radially outwardly of said upwardly facing mounting surface to form the uppermost surface of said body member, and means interconnecting said body member to said handle for pivotal rotation about a pivot axis disposed above said blade elongate arcuate surface.

10. A safety razor system as set forth in claim 9 wherein said pivot axis extends in the lengthwise direction of said blade elongate surface.

11. A safety razor system as set forth in claim 10 wherein said blade is mounted on said shell structure to cover said shell open portion.

12. A safety razor system comprising:

a body member for attachment to a razor handle and comprising, a shell structure having an upwardly facing mounting surface, and a substantially open central portion, and a blade having a substantially elongate surface with a plurality of apertures formed therein, the perimeter of each said aperture forming a cutting edge, said blade being mounted onto said shell structure mounting surface to cover said shell open central portion, and having substantially all said cutting edges of said substantially elongate surface disposed above said body member upwardly facing mounting surface, said blade further having a peripheral surface extending outwardly from said blade elongate surface and spaced radially inwardly therefrom, said peripheral surface of said blade being received on said upwardly facing mounting surface of said shell, and a cap member extending about the upper surface of, and affixed to said shell structure, said cap member having a lip extending inwardly over said shell structure upwardly facing mounting surface and clamping said blade peripheral surface therebetween.

13. A safety razor shaving system as set forth in claim 12 wherein said cap member further comprises an outwardly extending portion disposed over its length, said cap member portion having an upwardly facing groove formed therein, and a skin conditioning means in the form of a solid strip of material, said solid strip of material being retained in said cap member groove and extending upwardly to a point adjacent said cap member lip.

* * * * *